US011373822B2

(12) United States Patent
Lai et al.

(10) Patent No.: US 11,373,822 B2
(45) Date of Patent: Jun. 28, 2022

(54) KEYBOARD KEY SWITCHES

(71) Applicant: Kingston Technology Corporation, Fountain Valley, CA (US)

(72) Inventors: Jian-Cheng Lai, Taoyuan (CN); Wei-Min Liang, Hsinchu (CN); Kuo Shou Yu, Taoyuan (CN)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/892,809

(22) Filed: Jun. 4, 2020

(65) Prior Publication Data

US 2021/0383988 A1 Dec. 9, 2021

(51) Int. Cl.
*H01H 13/85* (2006.01)
*H01H 13/86* (2006.01)
*H01H 13/7073* (2006.01)

(52) U.S. Cl.
CPC ..... *H01H 13/85* (2013.01); *H01H 13/7073* (2013.01); *H01H 13/86* (2013.01)

(58) Field of Classification Search
CPC .... H01H 13/85; H01H 13/7073; H01H 13/86; H01H 13/14; H01H 13/20; H01H 13/66; H01H 13/28; H01H 13/705; H01H 13/30; H01H 5/08; H01H 5/06; H01H 1/10; H03K 17/94
USPC ..... 200/5 A, 50.36, 51.16, 412, 417, 422, 200/453, 276.1, 277.1, 314, 341, 520, 200/517, 529, 553, 339
See application file for complete search history.

(56) References Cited

U.S. PATENT DOCUMENTS 4,479,040 A * 10/1984 Denley ..... H01H 13/50 200/342
4,553,009 A * 11/1985 Van Zeeland ..... H01H 13/705 200/517
4,939,327 A * 7/1990 Wu ..... H01H 13/50 200/341
4,990,731 A * 2/1991 Wu ..... H01H 13/50 200/345
5,095,181 A * 3/1992 Osika ..... H01H 3/20 200/339
6,878,894 B2 * 4/2005 Schwarz ..... H01H 15/107 200/341
7,122,756 B2 * 10/2006 Sasaki ..... H01H 13/023 200/520
9,728,350 B2 * 8/2017 Muller ..... H01H 13/50
10,102,987 B1 * 10/2018 Alexander ..... H01H 13/78
10,585,493 B2 3/2020 Elias
(Continued)

FOREIGN PATENT DOCUMENTS

CN 204441139 U 7/2015
CN 106571257 B 4/2017
WO WO2019196611 A1 10/2019

*Primary Examiner* — William A Bolton

(57) ABSTRACT

Key switches of the inventive subject matter are designed to give users the tactile feel of key switches from expensive mechanical keyboards without drawback typically associated with alternative key switches. In some embodiments, key switches described in this application are designed to function with a sheet of membrane switches. These embodiments feature a plunger and rocker combination that prevents the pressure from a user's key press from being directly transferred to a membrane switch, thereby reducing wear and tear.

12 Claims, 8 Drawing Sheets

(56) References Cited

U.S. PATENT DOCUMENTS

2016/0071662 A1* 3/2016 Cai ..... H01H 13/14
200/314
2017/0294276 A1* 10/2017 Liu ..... H01H 3/50

* cited by examiner

FIG. 1A
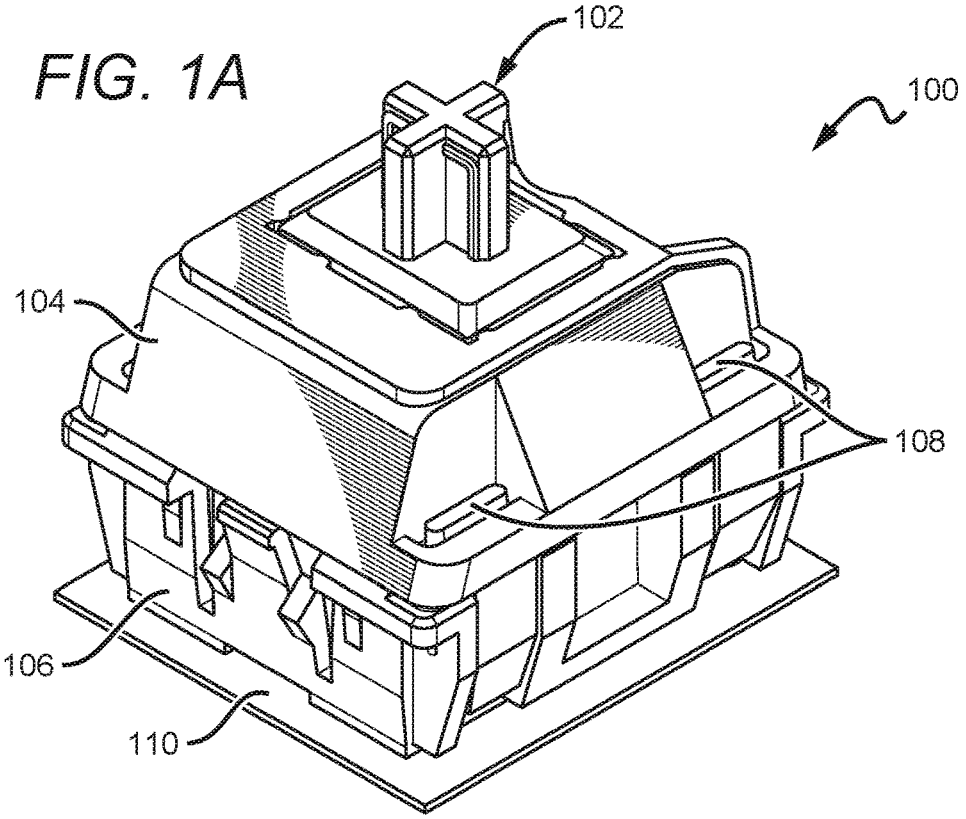
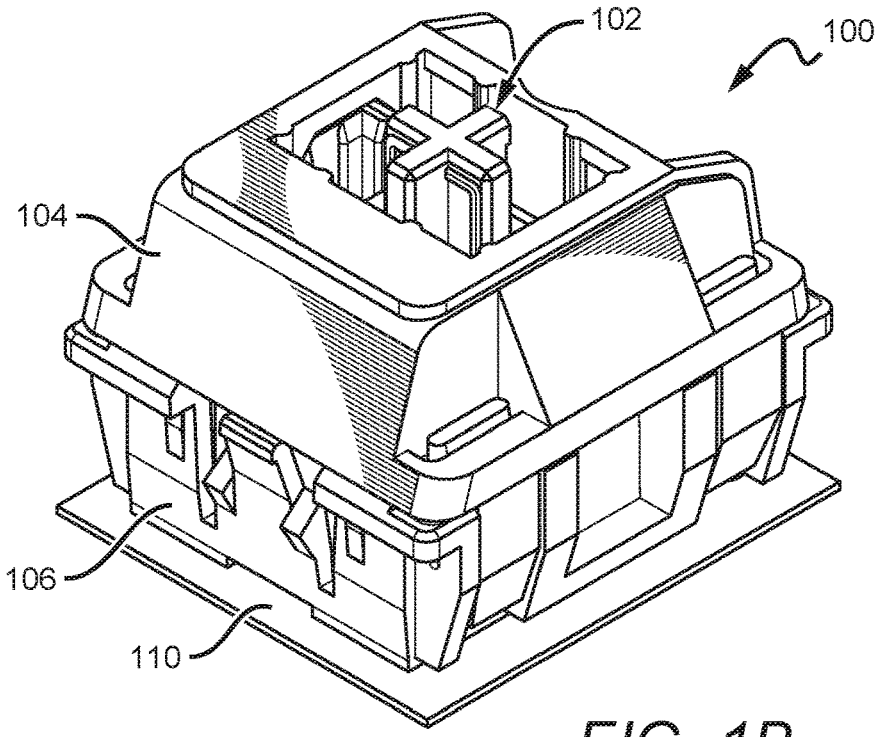
FIG. 1B

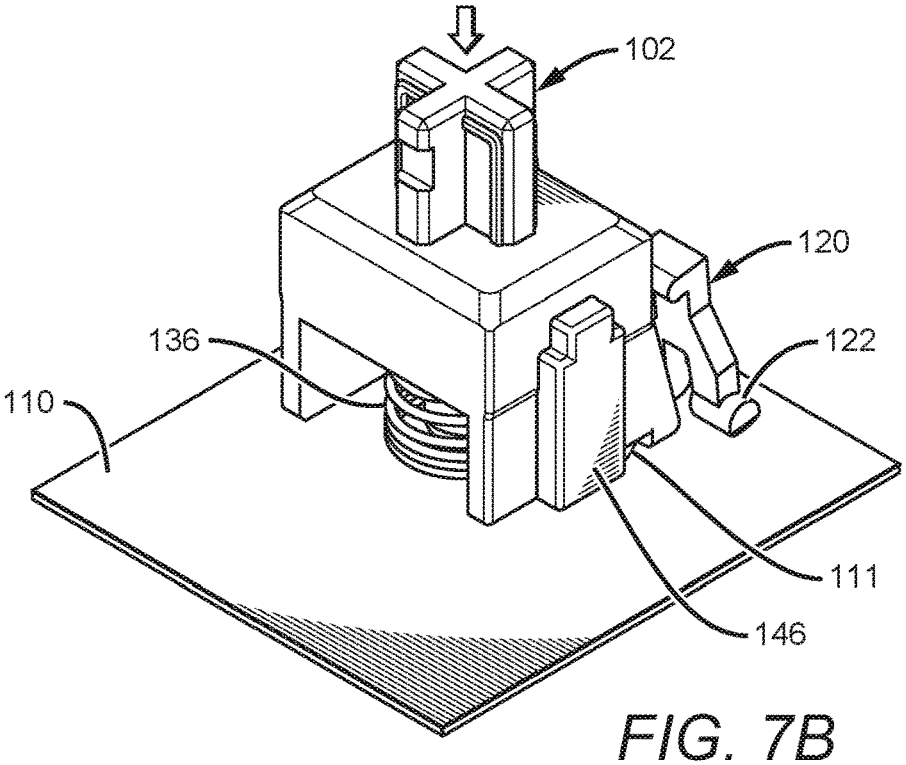
FIG. 7B
FIG. 8
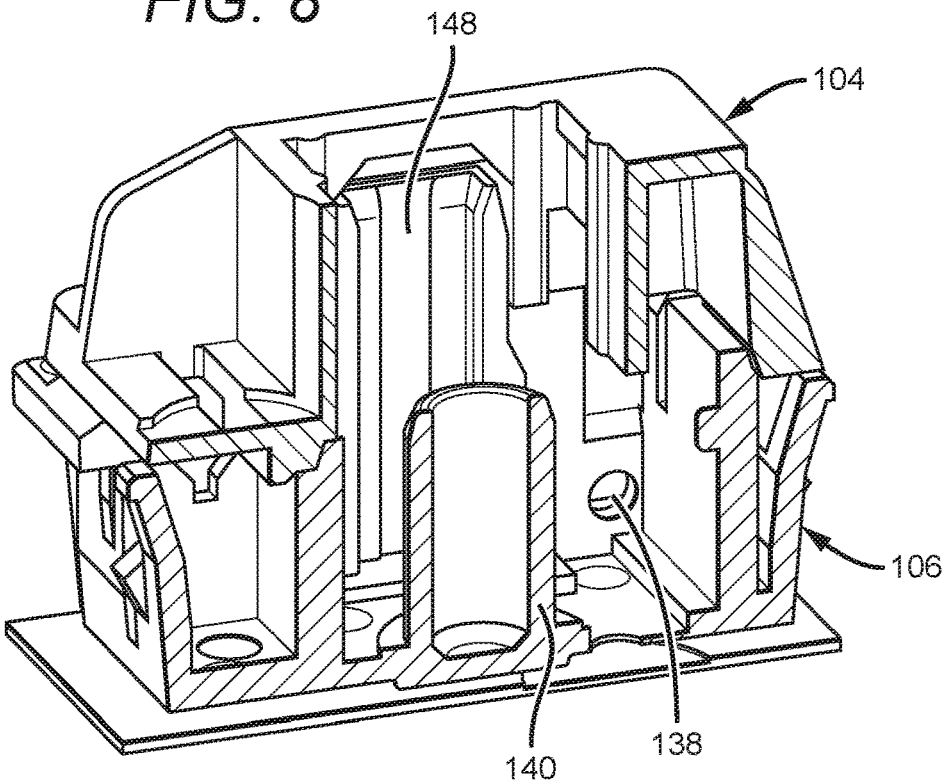

KEYBOARD KEY SWITCHES

FIELD OF THE INVENTION

The field of the invention is key switches for keyboards.

BACKGROUND

The background description includes information that may be useful in understanding the present invention. It is not an admission that any of the information provided in this application is prior art or relevant to the presently claimed invention, or that any publication specifically or implicitly referenced is prior art.

Early keyboards were known, in part, for the sound the keys made when pressed. The recognizable clicking was the result of each key being configured as an actual physical switch that, when actuated, resulted in creating an electrical signal or closing/opening a circuit that a computer interpreted as a key press. Because these early keyboards used mechanical switching, they had a distinct feel associated with the force required for each key to register a keypress. As keyboards evolved, newer technology began to replace these old mechanical keyboards, resulting in the loss of the look and feel of the original mechanical keyboards.

One technology that reduced keyboard cost and helped moved the industry away from mechanical keyboards was the membrane switch. With membrane switches, keyboards could be lower profile, have keys that could be actuated with less force and less travel, and they were much cheaper. But computing—and especially gaming—enthusiasts have often preferred the feel and sound of a mechanical keyboard, not to mention the reliability. Now, more than just enthusiasts choose mechanical keyboards. Today, an entire industry exists to serve these once-niche groups. But mechanical keyboards remain more expensive than membrane switch-based keyboards, and because membrane switches are more prone to wear and tear, a mechanical key switch that actuates a membrane switch must isolate the force of a key press from transferring to the membrane. A need has therefore arisen for a membrane switch-based keyboard having the sound, feel, and reliability of a mechanical keyboard.

Some efforts have been made to improve key switches, but these all fall short in accurately replicating the feel of a mechanical key switch while benefiting from the use of inexpensive membrane switches. For example, International Application WO2019196611A1 discloses a keyboard with a mechanical key switch with an associated membrane. The '611 Application features a shaft disposed within a plunger, where the shaft is coupled with the plunger by a spring, thus separating the force of a user's key press from directly impacting the membrane switch. Although this application does control some of the force that is applied to the membrane switch, its configuration does not fully isolate the force of a user's key press from the membrane, resulting in force applied to the membrane from being inconsistent, which results in unnecessary wear and tear. The '611 Application thus discloses a key switch that does not allow for precise control over how much pressure is applied to the membrane, and is incapable of causing the same force to be applied regardless of how hard or fast a user presses a key.

This and all other extrinsic materials discussed in this application are incorporated by reference in their entirety. Where a definition or use of a term in an incorporated reference is inconsistent or contrary to the definition of that term provided in this application, the definition of that term provided in this application applies and the definition of that term in the reference does not apply.

It has yet to be appreciated that key switches can be designed to benefit from membrane switching without sacrificing reliability, feel, or sound that are hallmark of true mechanical key switches. Thus, there is still a need in the art for improved key switches.

SUMMARY OF THE INVENTION

The present invention includes systems and methods directed to key switches for use in keyboards. In one aspect of the inventive subject matter, a key switch is contemplated to include: a lower casing having an actuator hole through a bottom surface; an upper casing having a plunger hole through a top surface and configured to couple with the lower casing to form an interior space; a plunger comprising a sloped surface, wherein the plunger movably couples with the lower casing; and a rocker disposed within the interior space. The rocker includes a first pivot point and a second pivot point, where the first pivot point couples with a first side of the lower casing and the second pivot point couples with a second side of the lower casing. The rocker also includes a hammer disposed on a first portion of the rocker and an actuator disposed on a second portion of the rocker, where the first portion of the rocker exists on a first side of the first and second pivot points and the second portion of the rocker exists on a second side of the first and second pivot points. The key switch also includes a spring disposed between the lower casing and the rocker, where the spring is configured to press the hammer against the sloped surface. The rocker and the plunger are configured such that, upon depressing the plunger at least partially into the interior space, the rocker is configured to rotate about the first and second pivot points based on the hammer sliding along the sloped surface.

In some embodiments, the actuator extends through the actuator hole upon depressing the plunger. The actuator can thus be configured to, upon extending through the actuator hole, contact a membrane switch disposed below the key switch. In some embodiments, the plunger comprises an upper portion having a cross-shaped cross section to facilitate coupling a key cap thereto. In some embodiments, the plunger features a piston and the lower casing features a corresponding piston cavity. The piston in such embodiments is configured to fit at least partially within the piston cavity such that the piston cavity acts as a guide for the piston's movement, ensuring that went a user presses a key, the key travels up and down along an intended movement path. In some embodiments, the key switch also includes a second spring disposed between the lower casing and the plunger, where the piston and the piston cavity are disposed within an interior portion of the second spring.

In another aspect of the inventive subject matter, a key switch is contemplated to include: a casing having an actuator hole through a bottom surface; a plunger comprising a sloped surface, where the plunger movably couples with the casing; and a rocker at least partially disposed within the casing. The rocker includes a hammer disposed on a first portion of the rocker and an actuator disposed on a second portion of the rocker, and a spring is disposed between the casing and the rocker. The spring is configured to press the hammer against the sloped surface, and, upon depressing the plunger at least partially into the interior space, the rocker is configured to rotate based on an interaction of the hammer with the sloped surface.

In some embodiments, the actuator extends through the actuator hole upon depressing the plunger, and the actuator is configured to, upon extending through the actuator hole, contact a membrane switch disposed below the key switch. The plunger can include an upper portion having a cross-shaped cross section to facilitate coupling a key cap thereto. In some embodiments, the plunger also includes a piston and the casing features a piston cavity, where the piston is configured to fit at least partially within the piston cavity such that the piston cavity acts as a guide for the piston's movement. In some embodiments, the key switch also includes a second spring disposed between the casing and the plunger, where the piston and the piston cavity are disposed at least partially in an interior portion of the second spring.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWING

FIG. 1A is a front perspective view of a key switch embodiment with its plunger undepressed.

FIG. 1B is a front perspective view of a key switch embodiment with its plunger depressed.

FIG. 7B is a front perspective view of the internal components with the plunger depressed.

FIG. 8 is a rear perspective cutaway view of the upper and lower casing without the internal components shown.

DETAILED DESCRIPTION

Figure 2A:
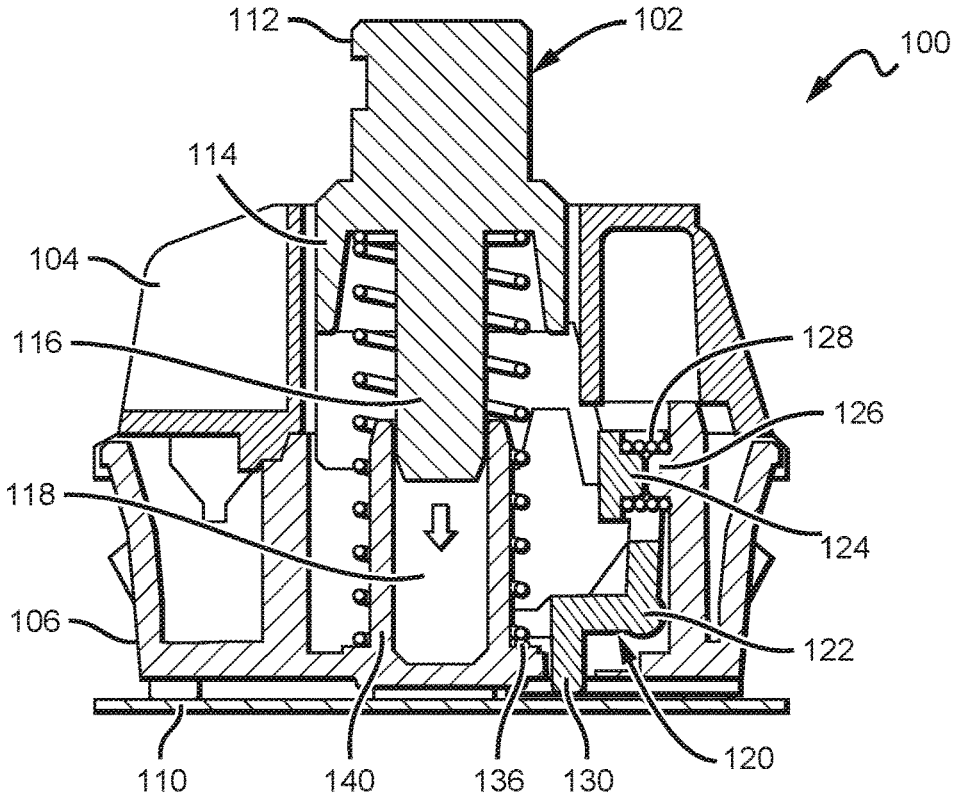
FIG. 2A is a side getaway view of the key switch embodiment with its plunger undepressed.

The following discussion provides example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

As used in the description in this application and throughout the claims that follow, the meaning of "a," "an," and "the" includes plural reference unless the context clearly dictates otherwise. Also, as used in the description in this application, the meaning of "in" includes "in" and "on" unless the context clearly dictates otherwise.

Also, as used in this application, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements. Moreover, and unless the context dictates the contrary, all ranges set forth in this application should be interpreted as being inclusive of their endpoints and open-ended ranges should be interpreted to include only commercially practical values. Similarly, all lists of values should be considered as inclusive of intermediate values unless the context indicates the contrary.

The inventive subject matter is directed to keyboard switches (also referred to as key switches) that are configured for use with a sheet of membrane switches disposed below them. Mechanical keyboards are desirable for a variety of reasons, including how the keys feel when they are pressed. This feel comes from the nature of those switches: key switches in traditional mechanical keyboards feature mechanical switches therein, and when a key switch is actuated (by, e.g., a key press), the switch is actuated and a key is registered by a computer as being pressed. Mechanical keyboards are often used by gamers, and small enthusiast communities have created the space for an entire market segment. But creating a keyboard using mechanical key switches results in an expensive keyboard. Key switches of the inventive subject matter forego the inclusion of an actual switch built into each key switch and is instead configured to actuate a membrane switch. This configuration results in a less expensive key switch that has the same feel as a mechanical key switch.

FIG. 1A shows a key switch 100 of the inventive subject matter with the plunger 102 in its undepressed resting position. Plunger 102 is disposed within a housing made from an upper casing 104 and a lower casing 106. Lower casing 106 features tabs 108 that fit into slots in the upper casing 104 (e.g., the slots shown in FIGS. 1A & 1B). When the casings 104 and 106 are coupled together, they form a slot for plunger 102 to depress into.

FIG. 1B shows the key switch 100 with the plunger 102 depressed. Plunger 102 features a cross-shaped protrusion that is designed according to industry standard for keycaps, where one of the cross members features notch (visible in FIGS. 2A and 2B). Keycaps (e.g., the portion of a keyboard that a user presses to actuate a key switch) feature a cross-shaped intrusion on their undersides so that the keycaps can be coupled with a key switch (key caps essentially click onto the cross-shaped protrusion). The upper casing 104 features a non-circular cutout for the plunger 102 so that the plunger 102 cannot freely rotate within the casings. This ensures keycaps remain properly oriented on an assembled keyboard. Finally, a membrane 110 comprising a plurality of membrane switches (e.g., a switch below each key switch) is shown below the key switch 100. In an assembled keyboard, the membrane would include as many switches as there are key switches in the keyboard that the key switches are implemented in.

FIG. 2A shows a side cutaway view of key switch 100, showing a profile view of the internal components. As mentioned above, plunger 102 features a cross-shaped upper protrusion 112. Below the protrusion 112 is a cup-shaped flared portion 114, where the opening of the cup faces downward. The flared portion (the portion that the protrusion 112 protrudes from) is sized and dimensioned to fit within the opening in the top of the upper casing 104. The cup portion faces downward therefrom and features a piston 116 that extends downward from the middle of the cup portion. As shown in FIG. 2A, when the plunger 102 is undepressed, piston 116 fits partially into piston cavity 118. An arrow drawn inside cavity 118 indicates that, upon a key press, the piston 116 (and the entire plunger component) moves downward such that the piston 116 fills more of the piston cavity 118 as shown in FIG. 2B.

Figure 2B:
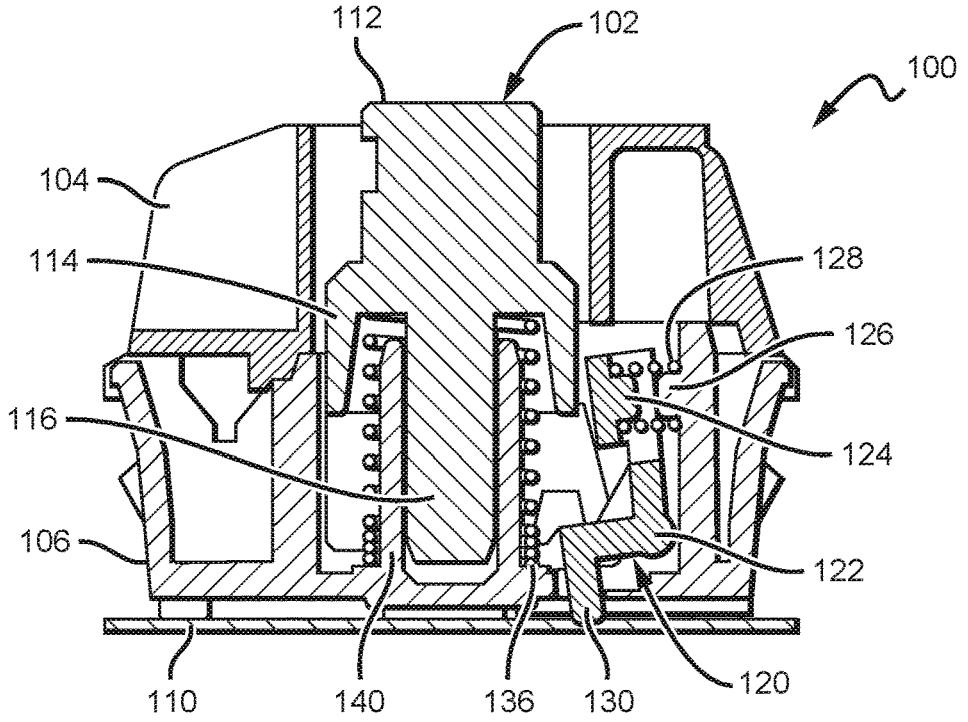
FIG. 2B is a side getaway view of the key switch embodiment with its plunger depressed.
Figure 3A:
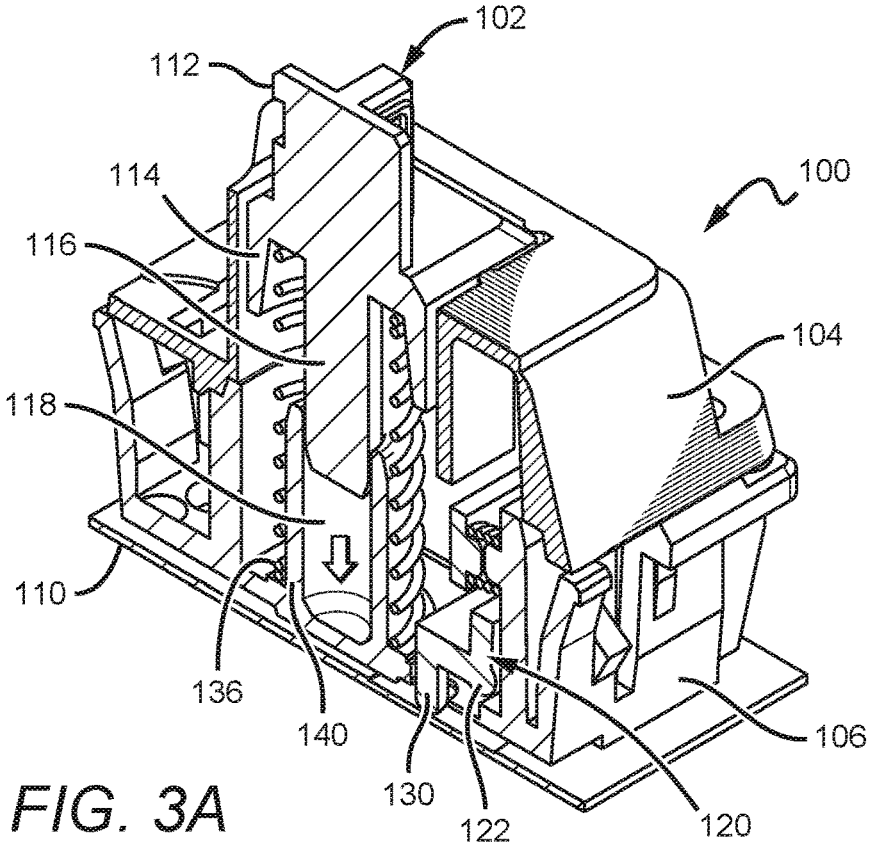
FIG. 3A is a cutaway view of the key switch embodiment with its plunger undepressed.
Figure 3B:
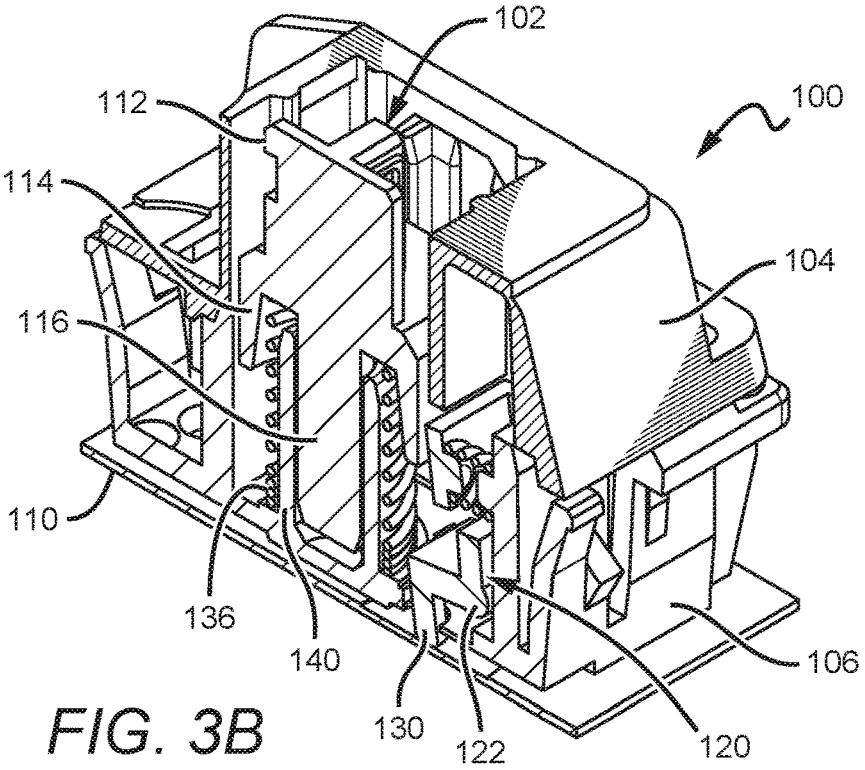
FIG. 3B is a cutaway view of the key switch embodiment with its plunger depressed.

Also shown in FIGS. 2A and 2B is a rocker 120. Rocker 120 is disposed within the key casings 104 & 106, and it is configured to rotate about pivot point 122 (there are two pivot points per rocker, both of which are designated as 122 in this application). The upper portion of the rocker 120 features a rocker protrusion 126 that, when the key switch is in an undepressed configuration, contacts (or come close to contacting) a corresponding casing protrusion 124. Rocker protrusion 124 and casing protrusion 126 are configured such that, for example, a coil spring disposed between the rocker and the lower casing 106, where the spring 128 has an inner diameter that is larger than the greatest width measurement of the protrusions 124 & 126. Other types of springs are also contemplated, including a torsion spring configured to press the rocker 120 toward the center of the key switch. Protrusions 124 & 126 can have a circular cross section (e.g., to match the circular nature of ordinary coil springs), but such a configuration is not necessary so long as they are formed in such a way a coil spring is held in place when put into position between the rocker 120 and the lower casing 106. FIGS. 3A and 3B show the cutaway views in FIGS. 2A and 2B from a perspective view. These views make it easier to see the shapes and configurations of different components that may be more difficult to see in a side view.

Rocker 120 additionally features an actuator 130, is coupled with a bottom portion of the rocker 120 and configured to protrude through a hole in the bottom of the lower casing 106. In FIG. 2A actuator 130 is at its initial position (e.g., there is space between the actuator 130 and the membrane 110). FIG. 2B, on the other hand, shows the rocker 120 in a second position that occurs when a user presses on the key switch. Thus, the actuator 130 presses against the membrane 110 on a switching portion of the membrane 110, causing, e.g., a computer to register that a key has been pressed.

Figure 4A:
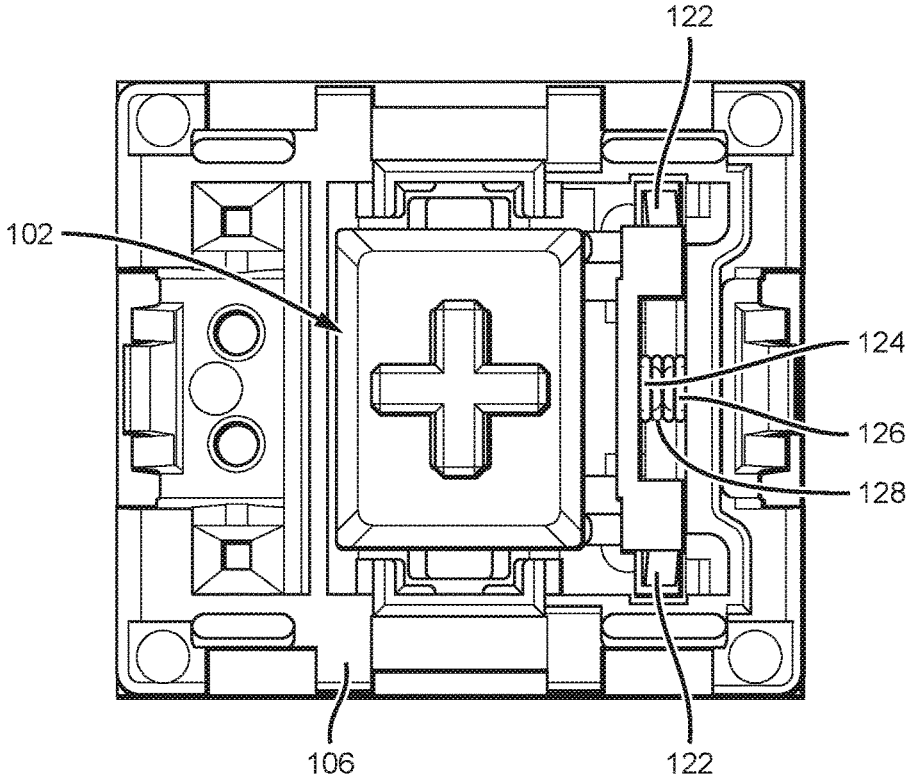
FIG. 4A is a top view of the key switch embodiment with its plunger undepressed.
Figure 4B:
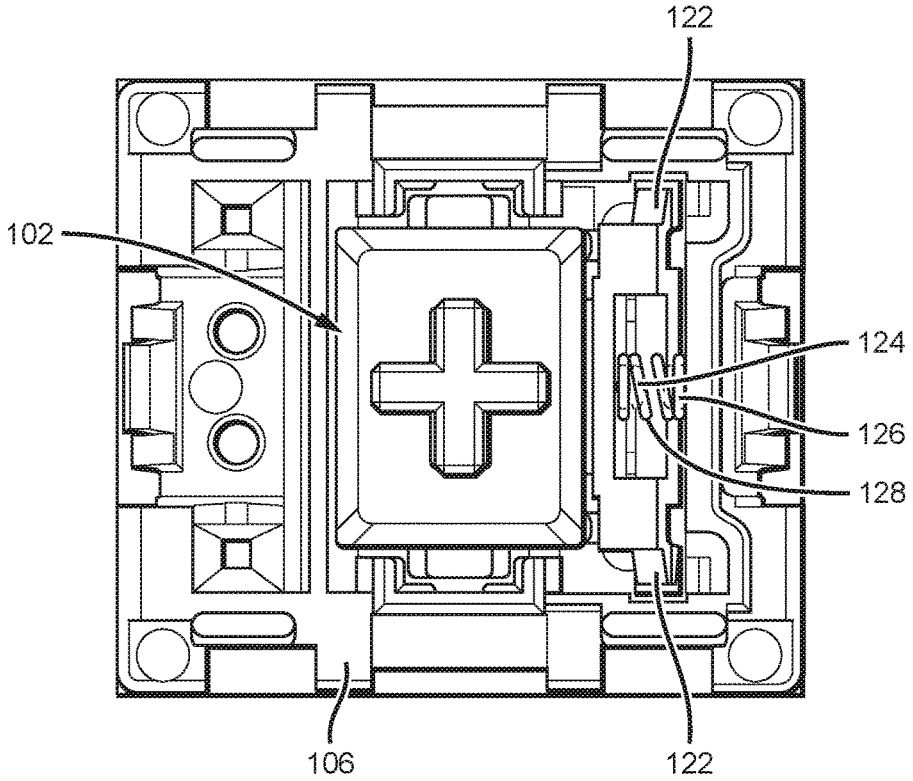
FIG. 4B is a top view of the key switch embodiment with its plunger depressed.

FIGS. 4A and 4B show a top view of the key switch 100 with the upper casing removed. FIG. 4A shows the key switch 100 in an undepressed position, while FIG. 4B shows the key switch 100 in a depressed position. Protrusions 124 and 126 are shown to move apart from one another between FIG. 4A and 4B as the plunger 102 is depressed. Spring 128 causes protrusion 124 to move away from protrusion 126 as the plunger 102 is depressed.

Figure 5A:
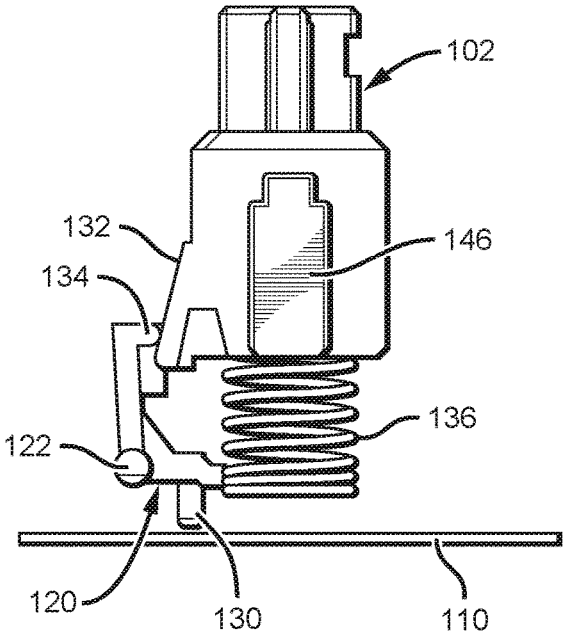
FIG. 5A is a sideview of the key switch embodiment without the upper casing with its plunger undepressed.
Figure 5B:
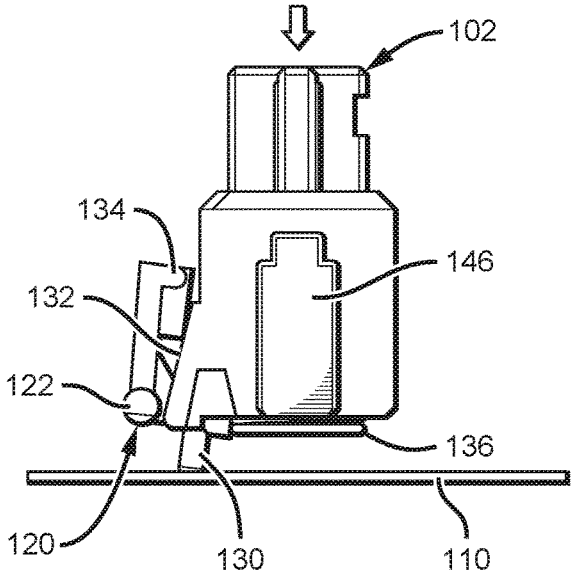
FIG. 5B is a side view of the key switch embodiment without the upper casing with its plunger depressed.

The mechanics behind movement of rocker 120 are best seen in FIGS. 5A and 5B, which show key switch 100 without the upper casing 104 or the lower casing 106. Plunger 102 features a sloped surface 132 that is positioned to interact with hammer 134 on rocker 120. At rest, as shown in FIG. 5A, hammer 134 rests against sloped surface 132 near a bottom portion. As plunger 102 moves downward, hammer 134 slides along sloped surface 132, where hammer 134 is pressed against the sloped surface 132 by spring 128 (shown in previous figures). Hammer 134 slides along the sloped surface 132 as the plunger 102 is depressed, causing rotation of the rocker about pivot point 122. Pivot point 122 comprises an extrusion on each side of rocker 132 that couple with the lower casing 106 at two coupling points (e.g., intrusions that are sized and dimensioned such that both pivot points can be disposed therein upon assembly). Both pivot points 122 can be seen in FIGS. 4A and 4B, which show the rocker 120 coupled with the lower casing 106. One such coupling point 138 is shown in FIG. 8, which shows the upper and lower casings 104 & 106 without any internal components disposed therein.

Movement of plunger 102 is resisted by spring 136, which exerts an upward reactive force against the plunger 102 when it is depressed according to the down arrow shown in FIG. 5B. Spring 136 is sized and dimensioned such that its inner diameter is larger than an outer diameter of piston 116. In some embodiments, piston 116 is not formed with a circular cross-section, and can be formed to have, e.g., a cross-shaped cross section, or some other cross section where the longest measurement across that cross section is less than the inner diameter of spring 136. Piston 116 has at least two purposes: it helps hold spring 136 in position when it is compressed or allowed to decompress, and it also acts as a guidepost for plunger 102. It helps to prevent plunger 102 from wobbling as it is depressed, ensuring that plunger 102 moves up and down along a single, vertical axis of movement.

Hollow protrusion 140 also cooperates with spring 136 as well as piston 116. Hollow protrusion 140 can be seen in FIGS. 2A-3B and FIG. 8. Piston 116, which is described as having an outer diameter (or, in some embodiments, largest width dimension) that is less than the inner diameter of spring 136, must also have an outer diameter that is smaller than the inner diameter of the hollow protrusion 140. Thus, as plunger 102 is depressed, piston 116 moves into hollow protrusion 140, which guides movement of the plunger, ensuring movement is restricted to up and down movement. Hollow protrusion 136 has an outer diameter that is smaller than the inner diameter of spring 136 so that spring 136 can be disposed around the both the hollow protrusion 140 and the piston 116. This configuration can be seen in, e.g., FIGS. 2A-3B.

Put together, key switches of the inventive subject matter prevent pressure from a user's finger from directly translating to a membrane, thereby reducing membrane wear and tear and increasing keyboard longevity. Instead, force from spring 128 causes rocker 120 to rotate such that its actuator 130 presses into a switching portion of the membrane 110. The pressure applied to the membrane 110 will not be impacted by how hard a user presses a key, and key switch force response that a user experiences is controlled by spring 136. Because spring 128 creates the force that is transferred to membrane 110 switch upon depressing plunger 102, spring 128 can thus be configured (e.g., its wire diameter, length, material, etc. can be deliberately selected) so that it creates a desired force that the rocker applies to the membrane 110.

Figure 6A:
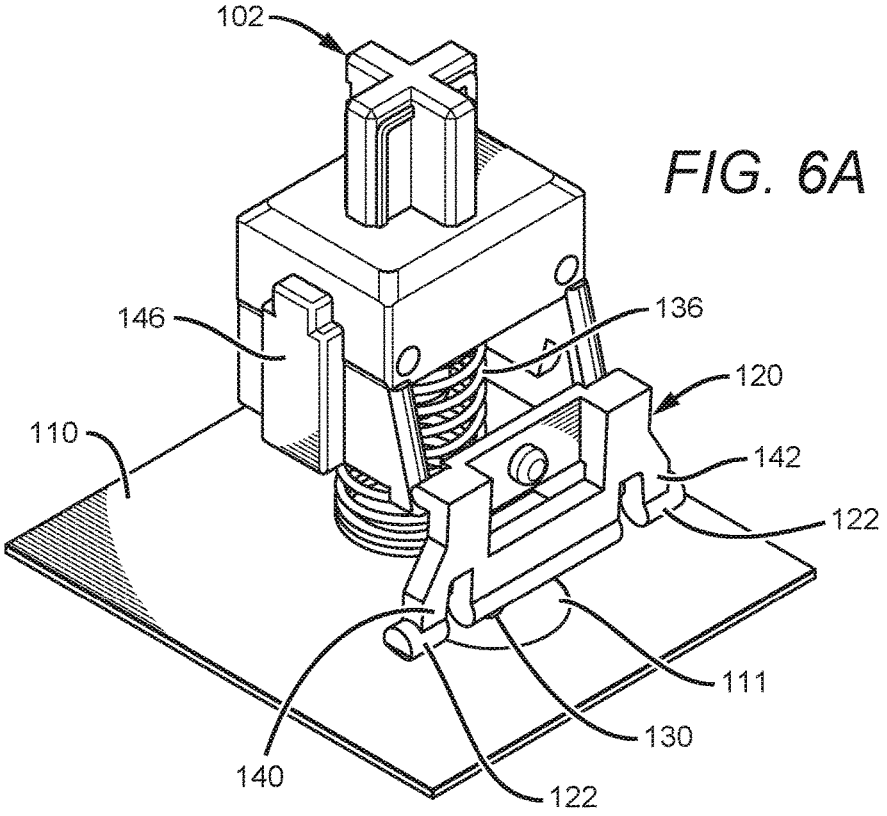
FIG. 6A is a rear perspective view of the internal components with the plunger undepressed.
Figure 6B:
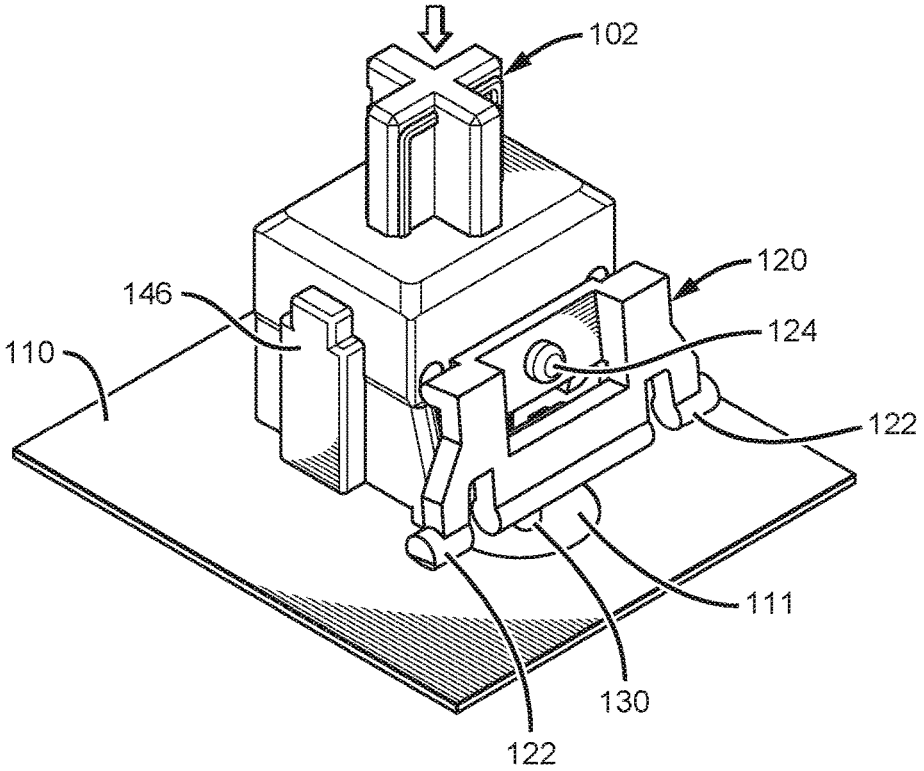
FIG. 6B is a rear perspective view of the internal components with the plunger depressed.

FIG. 6A shows plunger 102 and rocker 120 before the plunger is depressed, and FIG. 6B shows the same components after the plunger 102 is depressed. These views show features of plunger 102 and rocker 120 that might otherwise be more difficult to see in the other figures. For example, pivot points 122 are shown to exist on the ends of two arms 142 & 144. These arms exist to facilitate coupling the rocker 120 with the lower casing 106. To fit pivot points 122 into coupling holes 138 (one of which is shown in FIG. 8, the other being symmetrically disposed on the other side of the lower casing 106, not shown because FIG. 8 shows a cutaway view), arms 142 and 144 are configured to flex inward. When arms 142 and 144 flex inward, pivot points 122 can be fit into coupling holes 138. Once disposed within coupling holes 138, rocker 120 can rotate about pivot point 122.

Figure 7A:
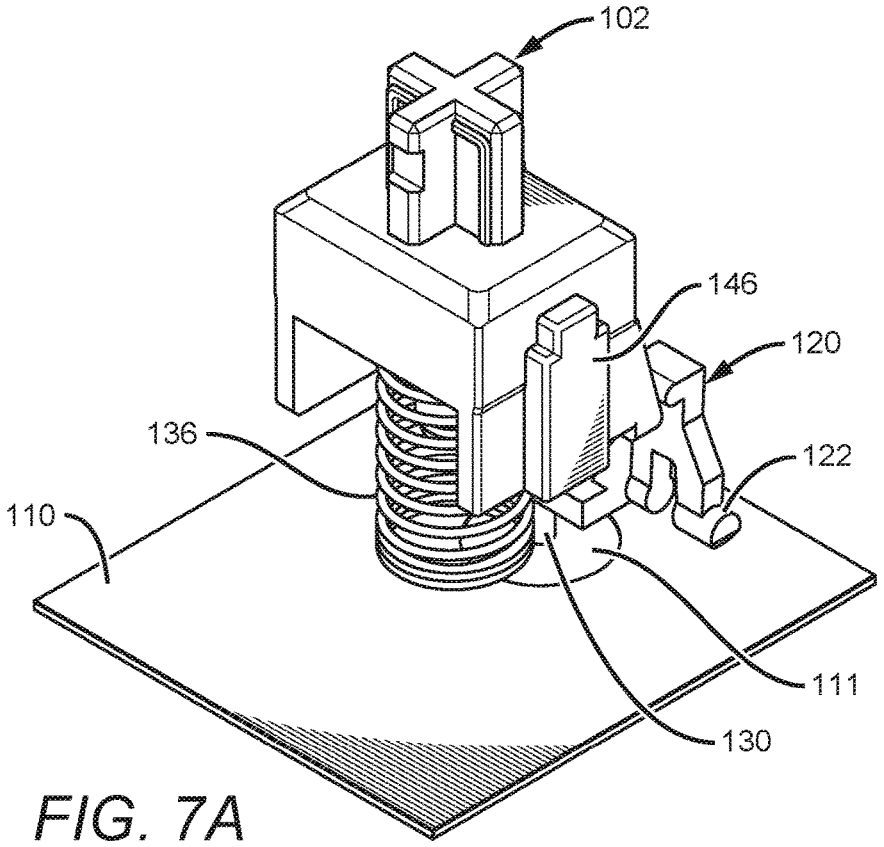
FIG. 7A is a front perspective view of the internal components with the plunger undepressed.

FIGS. 7A and 7B show another view of the internal components of key switch 100, including plunger 102, rocker 120, and spring 136. FIG. 7A, as with FIG. 6A, shows undepressed plunger 102 with rocker 120 in its default position where actuator 130 is not in contact with the membrane 110, while in FIG. 7B, the plunger 102 is shown in a depressed position with the rocker in its rotated position such that actuator 130 comes into contact with the membrane 110. Membrane 110, as seen in various figures, features a circular portion denoting the switching area 111. When actuator 130 contacts switching area 111, the membrane 110 registers a keypress.

FIGS. 7A-7B also show features 146 on the outer surface of the plunger 102 that are configured to prevent plunger 102 from coming out of casings 104 & 106 when the casings are coupled together to form the key switch 100. Features 146 are configured such that the plunger 102 is wider than the hole for the plunger on the upper casing 104 (e.g., the hole through which the top portion of the plunger 102 extends as seen especially in FIGS. 1A and 1B), thereby preventing plunger 102 from coming out the top of the upper casing. Lower casing 106 accordingly include features complementary to features 146. These complementary features comprise slots 148 that extend vertically, where the upper casing 104 overhangs the slots to prevent the plunger 102 from coming out the top of the upper casing 104 as explained above. Although only one slot 148 is shown in FIG. 8, lower casing 106 includes slots on both sides to accommodate both features 146 disposed on the sides of plunger 102.

Figure 9:
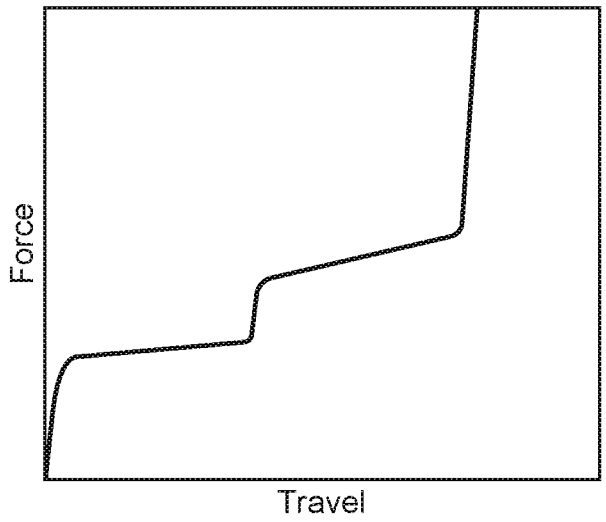
FIG. 9 is a graph of force versus travel for an ordinary membrane key switch.

Put together, embodiments of the inventive subject matter produce a force response like that of a key switch from a mechanical keyboard while maintaining advantages conferred by membrane keyboards. FIG. 9 shows a graph of force versus travel for an ordinary key having a membrane switch, where force is the reaction force against a user's finger upon pressing a key, and travel is measured by how far a key is pressed downward from its initial position. A step up in force occurs as the key contacts and subsequently actuates the membrane switch, followed up a slightly steeper force response as the key presses against both the spring and the membrane switch. This results in a distinct feel under the user's finger that is distinguishable from the feel of a mechanical key switch, where the feel of ordinary membrane-based key switches is typically associated with lower cost and lower quality keyboards. Finally, the tail end of the graph shows a large increase in force as the key is fully depressed. The membrane bears that force increase, which can result in damage to the membrane. Embodiments of the inventive subject matter prevent this while improving force response.

Figure 10:
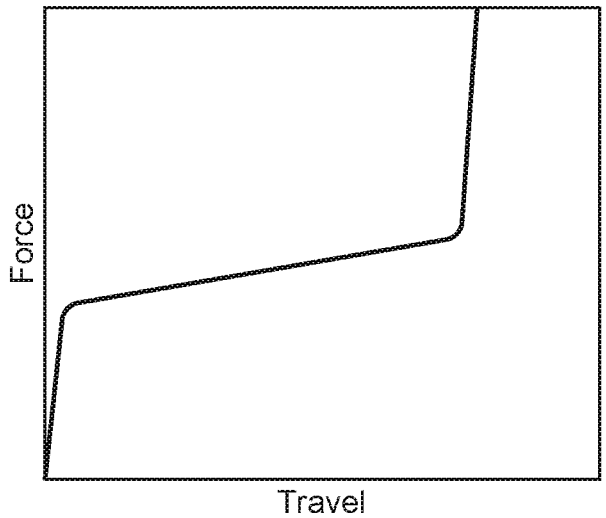
FIG. 10 is a graph of force versus travel for a key switch of the inventive subject matter.

FIG. 10 shows a similar force versus travel graph for a key switch of the inventive subject matter. There is an initial jump in force response as the key is pressed from rest, then the graph shows a linear increase in force response that is attributable the linear relationship between force and change in position for ordinary springs. Switches that exhibit this kind of behavior are referred to as "linear switches" and are desirable among, e.g., keyboard enthusiasts and gamers. In this case, that relationship is defined by spring 136. In some embodiments, spring 136 can be made from, e.g., a shape memory alloy to create a key switch having a nearly flat force response as a key is depressed. Once a key switch bottoms out (e.g., it is fully depressed), there is an increase in force as shown at the end of FIG. 10 caused by the plunger reaching the limits of its mobility as defined by the lower casing. The inventive subject matter is designed so that this increase in force is not applied directly to a membrane switch. The membrane switch is instead subject to the same force no matter how hard a key switch is depressed by a user because force applied to the rocker is defined by the spring between the rocker and the lower casing.

Thus, specific systems and devices relating to key switches have been disclosed. It should be apparent to those skilled in the art that many more modifications besides those already described are possible without departing from the inventive concepts in this application. The inventive subject matter, therefore, is not to be restricted except in the spirit of the disclosure. Moreover, in interpreting the disclosure all terms should be interpreted in the broadest possible manner consistent with the context. In particular the terms "comprises" and "comprising" should be interpreted as referring to the elements, components, or steps in a non-exclusive manner, indicating that the referenced elements, components, or steps can be present, or utilized, or combined with other elements, components, or steps that are not expressly referenced.

What is claimed is:

1. A key switch comprising:

a lower casing having an actuator hole through a bottom surface;

an upper casing having a plunger hole through a top surface and configured to couple with the lower casing to form an interior space;

a plunger comprising a sloped surface, wherein the plunger movably couples with the lower casing, wherein a first spring is positioned between the plunger and the lower casing;

a rocker disposed within the interior space;

wherein the rocker comprises a first pivot point and a second pivot point, the first pivot point coupling with a first side of the lower casing and the second pivot point coupling with a second side of the lower casing;

wherein the rocker further comprises a hammer disposed on a first portion of the rocker and an actuator disposed on a second portion of the rocker;

wherein the first portion of the rocker exists on a first side of the first and second pivot points, and wherein the second portion of the rocker exists on a second side of the first and second pivot points;

a second spring disposed between the lower casing and the first portion of the rocker;

wherein the second spring directly contacts the lower casing and is configured to press the hammer against the sloped surface; and wherein, upon depressing the plunger into the interior space, the rocker is configured to rotate about the first and second pivot points based on the hammer sliding along the sloped surface such that the actuator extends through the actuator hole.

2. The key switch of claim 1, wherein the actuator is configured to, upon extending through the actuator hole, contact a membrane switch disposed below the key switch.

3. The key switch of claim 1, wherein the plunger comprises an upper portion having a cross-shaped cross section to facilitate coupling a key cap thereto.

4. The key switch of claim 1, wherein the plunger comprises a piston and the lower casing comprises a piston cavity, and wherein the piston is configured to fit at least partially within the piston cavity such that the piston cavity acts as a guide for the piston's movement.

5. The key switch of claim 4, wherein the piston and the piston cavity are disposed at least partially within an interior portion of the first spring.

6. The key switch of claim 1, wherein the first spring creates a first reaction force that is approximately orthogonal to a second reaction force created by the second spring.

7. A key switch comprising:

a casing having an actuator hole through a bottom surface, the casing forming an interior space;

a plunger comprising a sloped surface, wherein the plunger movably couples with the casing, wherein a first spring is positioned between the plunger and the lower casing;

a rocker at least partially disposed within the casing;

wherein the rocker comprises a hammer disposed on a first portion of the rocker and an actuator disposed on a second portion of the rocker;

a second spring disposed between the casing and the first portion of the rocker;

wherein the second spring directly contacts the casing and is configured to press the hammer against the sloped surface; and wherein, upon depressing the plunger into the interior space, the rocker is configured to rotate based on an interaction of the hammer with the sloped surface such that the actuator extends through the actuator hole.

8. The key switch of claim 7, wherein the actuator is configured to, upon extending through the actuator hole, contact a membrane switch disposed below the key switch.

9. The key switch of claim 7, wherein the plunger comprises an upper portion having a cross-shaped cross section to facilitate coupling a key cap thereto.

10. The key switch of claim 7, wherein the plunger comprises a piston and the casing comprises a piston cavity, and wherein the piston is configured to fit at least partially within the piston cavity such that the piston cavity acts as a guide for the piston's movement.

11. The key switch of claim 10, wherein the piston and the piston cavity are disposed at least partially within an interior portion of the first spring.

12. The key switch of claim 7, wherein the first spring creates a first reaction force that is approximately orthogonal to a second reaction force created by the second spring.

* * * * *